US006691472B2

(12) United States Patent
Hubert

(10) Patent No.: US 6,691,472 B2
(45) Date of Patent: Feb. 17, 2004

(54) FOUNDATION WALL PROTECTOR

(76) Inventor: Theodore G. Hubert, 19370-36th Avenue, Surrey, British Columbia (CA), V4P 1M5

( * ) Notice: Subject to any disclaimer, the term of this patent is extended or adjusted under 35 U.S.C. 154(b) by 0 days.

(21) Appl. No.: 10/075,598

(22) Filed: Feb. 15, 2002

(65) Prior Publication Data

US 2003/0156905 A1 Aug. 21, 2003

(51) Int. Cl.[7] ..... E02D 19/00

(52) U.S. Cl. ..... 52/169.5; 52/169.14; 52/334; 52/302.1; 52/408; 52/403.1; 52/792; 405/36; 405/38; 405/43; 405/45; 405/47; 405/48; 405/49; 405/50; 405/107; 405/109; 405/116; 405/270; 428/137; 428/167; 428/178

(58) Field of Search ..... 52/169.5, 169.14, 52/480, 334, 792, 408, 302.1, 303, 305; 428/137, 167, 178; 405/43, 45, 38, 36, 50, 47, 48, 49, 107, 109, 116, 270

(56) References Cited

U.S. PATENT DOCUMENTS 3,888,087 A * 6/1975 Bergsland ..... 405/36
4,574,541 A * 3/1986 Raidt et al. ..... 52/169.5
4,730,953 A * 3/1988 Tarko ..... 405/45
4,733,989 A * 3/1988 Harriett ..... 405/43
4,749,306 A * 6/1988 Demeny et al. ..... 405/45
4,840,515 A * 6/1989 Freese ..... 405/45
4,943,185 A * 7/1990 McGuckin et al. ..... 405/45
4,956,951 A * 9/1990 Kannankeril ..... 52/169.5
5,044,821 A * 9/1991 Johnsen ..... 405/50
5,052,161 A * 10/1991 Whitacre ..... 52/385
5,256,007 A * 10/1993 Allen ..... 405/302.4
5,263,792 A * 11/1993 Davis et al. ..... 405/45
5,383,314 A * 1/1995 Rothberg ..... 52/169.5
5,423,629 A * 6/1995 Zimmerman ..... 405/129.8
5,489,462 A * 2/1996 Sieber ..... 428/174
5,529,438 A * 6/1996 Carriker et al. ..... 405/270
5,630,299 A 5/1997 Jackman et al.
5,688,073 A * 11/1997 Brodeur et al. ..... 405/45
5,794,388 A * 8/1998 Jackman ..... 52/169.5
5,820,296 A * 10/1998 Goughnour ..... 405/43
5,860,259 A * 1/1999 Laska ..... 52/302.3
6,065,901 A * 5/2000 Stevens et al. ..... 405/52
6,164,868 A * 12/2000 Goughnour ..... 405/43
6,241,421 B1 * 6/2001 Harvie et al. ..... 405/45

OTHER PUBLICATIONS

Armtec Limited, Platon Foundation Protector, undated.

* cited by examiner

*Primary Examiner*—Carl D. Friedman
*Assistant Examiner*—Christy M. Green

(57) ABSTRACT

A foundation protector for a foundation wall prevents moisture being retained in the foundation wall and also provides drainage for surface water so that water does not rest against the surface of the foundation wall. The foundation protector has a smooth exterior surface so that it remains attached to the foundation if earth subsidence occurs. The foundation protector includes a waterproof dimpled sheet with spaced-apart protrusions and an outer waterproof membrane which covers recesses formed by the protrusions and provides a substantially smooth exterior surface.

15 Claims, 6 Drawing Sheets

FOUNDATION WALL PROTECTOR

FIELD OF THE INVENTION

The present invention relates to the protection of foundations from water leakage and earth subsidence around the walls. More particularly the present invention provides a protector for foundations that has a drainage space for moisture to escape from the foundations themselves.

BACKGROUND OF THE INVENTION

Building structures that have foundation walls and floors made of concrete, concrete blocks, foam insulation and concrete composite blocks, wood or other materials are adversely affected over time by moisture, either moisture coming from the exterior or earth side of the foundations or alternatively, moisture that enters the foundations from the interior of the building. Most buildings have tile drains provided at the base of the foundation walls to remove water that penetrates the soil from above, but it is preferred to have waterproof protectors on the exteriors of foundation walls to prevent water entering the walls through cracks that occur over time.

One example of such a protector is disclosed in U.S. Pat. No. 4,956,951 to Kannankeril and has an array of spaced-apart projections that provides drainage space between a foundation wall and the protector. In the past, such protectors have been attached to the foundation walls either by nails or adhesive sheets that attach directly to the exteriors of the foundation walls. It has been found that adhesive sheets having the same area as the protectors do not permit the foundation walls to breathe and any moisture that may be retained in these walls cannot escape. Also, the use of nails has been undesirable because of the difficulty of properly installing the nails and the lack of secure attachment of the protectors to the foundation walls by the nails.

One other problem that has occurred with these protectors with spaced-apart projections positioned on foundation walls is due to the earth on the exterior of the walls filling the projections from the outside. Thus, if and when the earth subsides, it tends to pull the protectors away from the foundation wall. This leaves gaps between the protectors and the walls, which defeats the purpose of the protectors.

It is accordingly an object of the present invention to provide a novel protector for a foundation wall that is easily installed and permits moisture in the foundation to escape into a drainage space between the protector and the foundation.

It is another object of the present invention to provide a substantially smooth surface on the exterior of the protector to prevent the protector itself moving when earth adjacent the protector subsides.

It is still a further object of the present invention to provide at least one adhesive strip extending across a protector and attached to protrusions to provide attachment of the protector to a foundation wall.

SUMMARY OF THE INVENTION

The present invention provides a protector for a foundation wall, floor or other substantially flat foundation surface which includes protrusions extending from a base portion, the protrusions being for positioning adjacent the foundation surface and being spaced apart from one another to provide a drainage space between the foundation surface and the base portion of the protector, and an outer waterproof membrane on the base portion to cover recesses formed by the protrusions and provide a substantially smooth exterior surface to prevent movement of the protector due to earth subsidence.

The present invention also provides a concrete foundation protection system for providing drainage for foundation walls including a waterproof dimpled sheet with spaced-apart protrusions from a base portion, the protrusions for positioning adjacent the foundation walls to provide drainage space between the foundation walls and the base portion of the dimpled sheet, and an outer waterproof membrane on the base portion to cover recesses formed by the protrusions and provide a substantially smooth exterior surface to permit earth subsidence adjacent the membrane without movement of the dimpled sheet.

BRIEF DESCRIPTION OF THE DRAWINGS

In drawings, which illustrate embodiments of the present invention:—

DETAILED DESCRIPTION OF THE INVENTION

Figure 1:
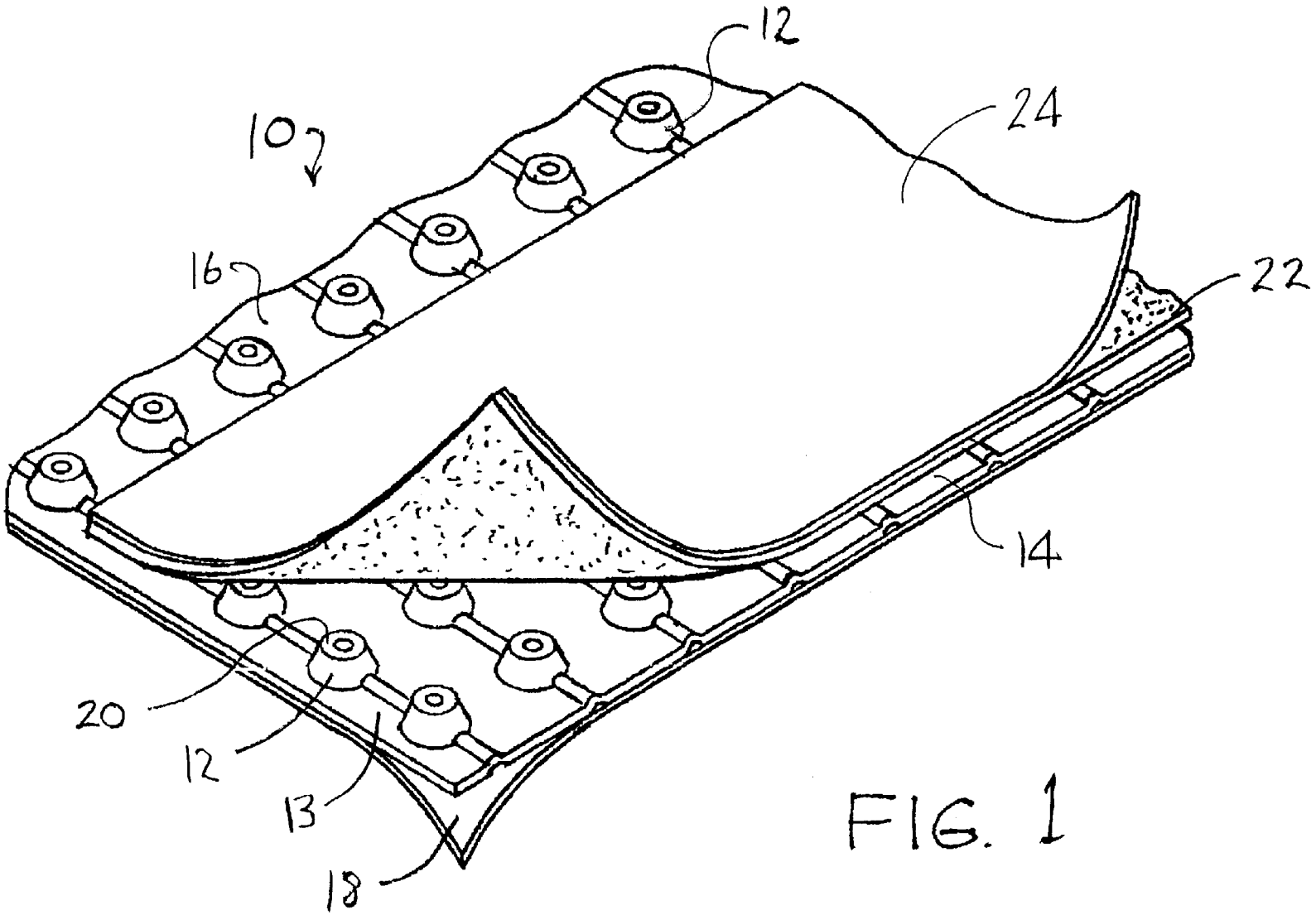
FIG. 1 is a partial perspective view of a foundation protector according to one embodiment of the present invention.

A waterproof foundation protector 10 according to one embodiment of the invention is illustrated in FIG. 1 and includes a waterproof dimpled sheet 16 which has a plurality of dimples or protrusions 12 spaced apart in a regular pattern as illustrated. The rows of protrusions 12 may be staggered or varied. The purpose of the protrusions 12 is to provide drainage space 14 between the waterproof dimpled sheet 16 and the outer surface of a concrete wall 26. The protrusions 12 extend from a base portion 13 and are integral therewith. Ridges 17 are shown extending linearly between the protrusions to provide additional strength to the waterproof dimpled sheet 16. In a preferred embodiment, the waterproof dimpled sheet 16 is formed from quasi-rigid high-density polyethylene or other suitable tough long-lasting plastic material. When the protrusions 12 are formed on the inner surface of the waterproof sheet 16, then corresponding recesses occur behind the protrusions 12 on the opposite outer surface of the waterproof sheet 16 and, as seen in FIG. 1, the underside surface of the base portions 13 is covered by an outer waterproof membrane 18 which is adhered to the sheet 16 so as to cover these recesses and provide a smooth exterior surface. The membrane 18 is preferably formed of medium density polyethylene, although any suitable long lasting plastic material may be used. The protrusions 12 have a substantially flat top surfaces 20 which abut the concrete wall 26 and, as shown in FIG. 1, a top adhesive strip 22 extends across the waterproof dimpled sheet 16 attached to the surfaces 20 of the protrusions 12. The top adhesive strip 22 has a tear-off protective sheet 24, which is removed before attachment to a foundation wall or other surface.

The waterproof dimpled sheet 16 and membrane 18 can, in one embodiment, incorporate UV protection in the form of 2% carbon black. The protector 10 may be of any desired color. Whereas the protector 10 is shown on a foundation wall, it may be used on concrete floors or on substantially flat surface where protection is desired.

Figure 2:
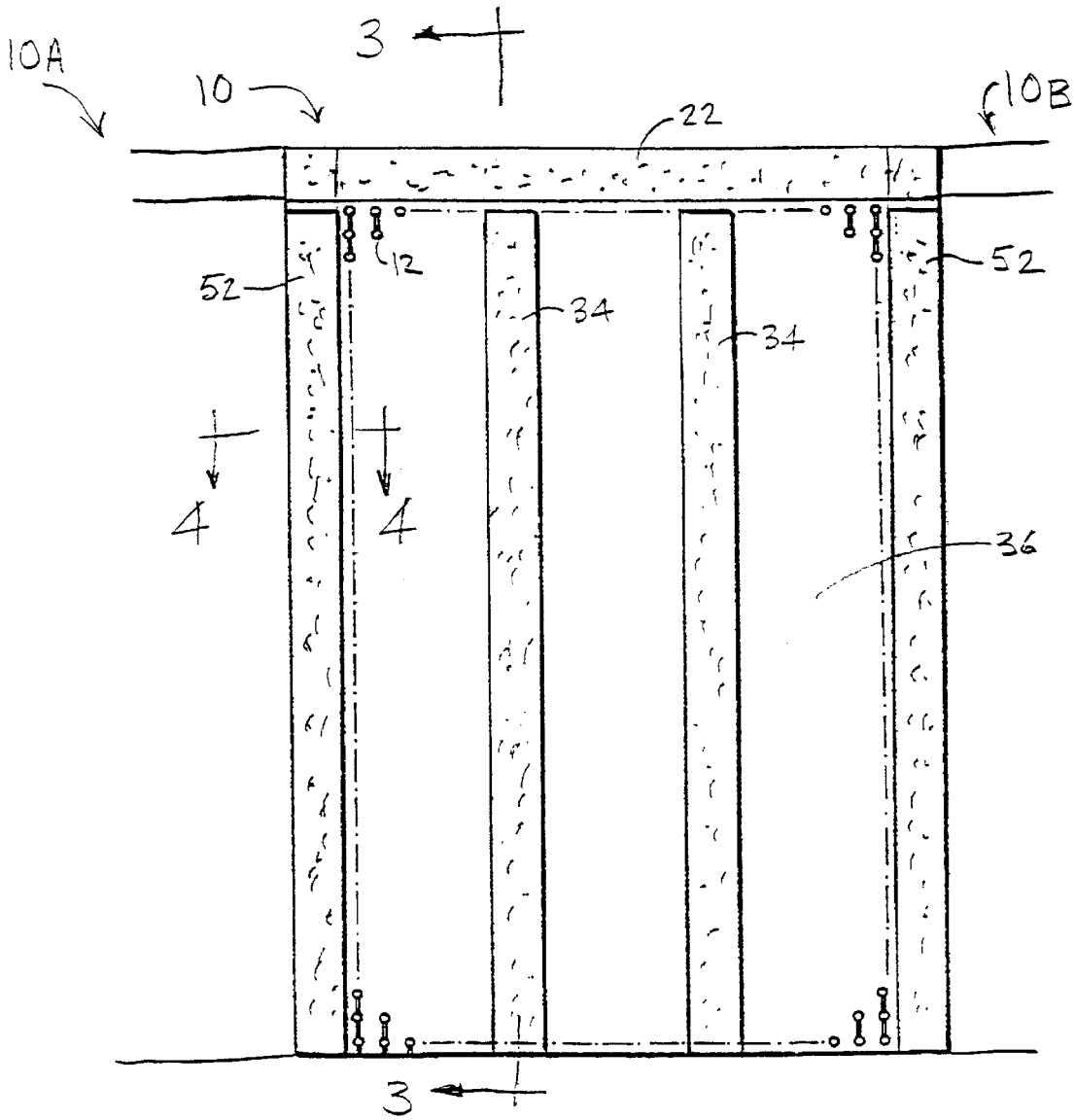
FIG. 2 is an elevational view of a foundation protector according to one embodiment of the present invention showing attachment strips for attachment to a foundation wall or floor.
Figure 3:
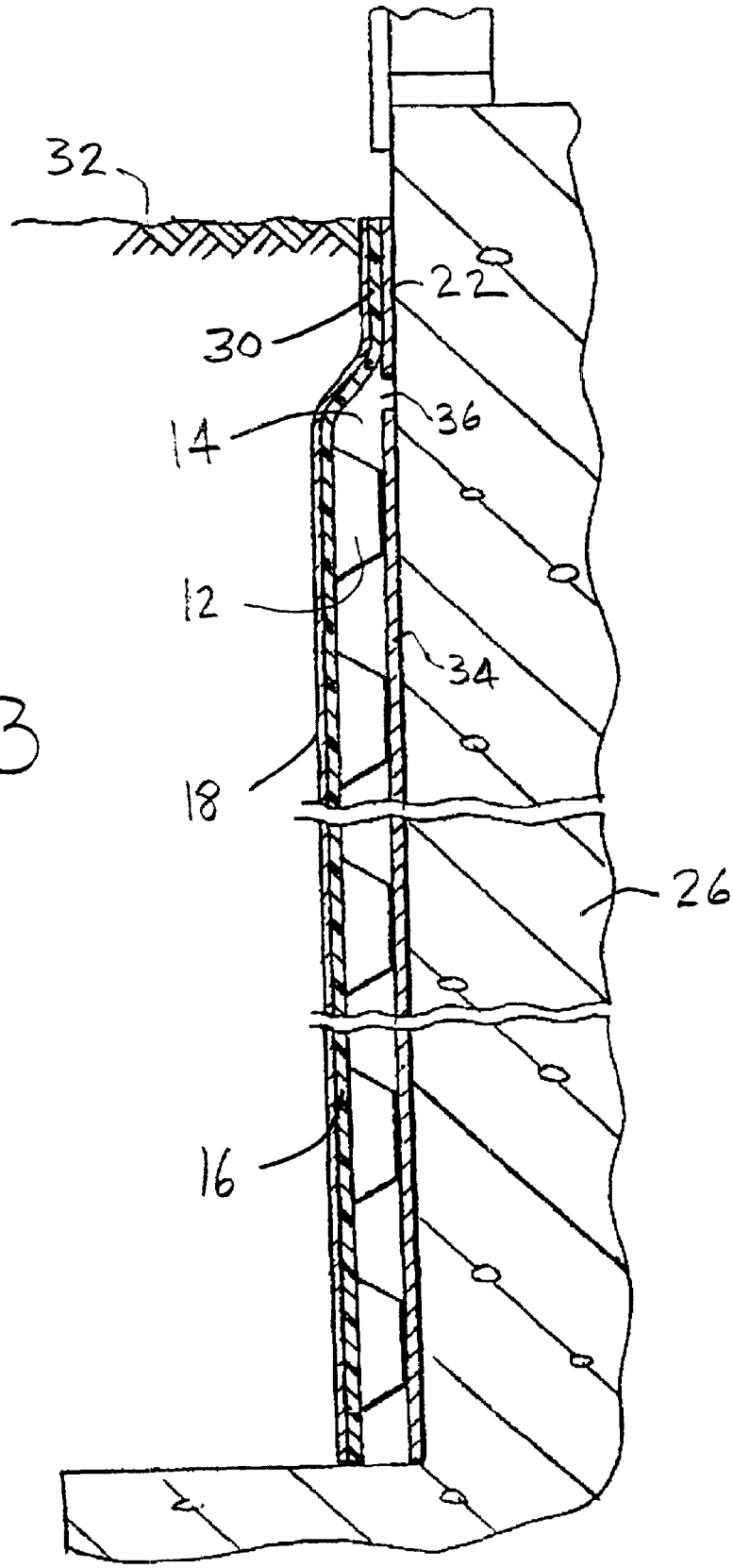
FIG. 3 is a longitudinal cross-sectional view of the foundation protector of FIG. 2 at line 3—3 positioned against a foundation surface.

A waterproof foundation protector 10 is shown in FIG. 2 with adjacent protectors 10A and 10B on either positioned on either side. A top adhesive strip 22 extends along the top edge of the waterproof dimpled sheet 16 attached to an offset flat portion 30 as shown in FIG. 3. When the top adhesive strip 22 is attached to the concrete wall 26, it forms a seal to prevent water on the earth 32 entering the drainage space 14 in the dimpled sheet 16. As can be seen in the drawings, the outer waterproof membrane 18 extends over the complete outside surface of the dimpled sheet 16 and thus provides a smooth surface and, if the earth 32 should subside downwards, it will not drag the dimpled sheet 16 down with it but the dimpled sheet 16 will remain affixed to the concrete wall 26.

Vertical adhesive attachment strips 34 are shown in FIG. 2 and FIG. 3 extending substantially perpendicularly downwards from the top adhesive strip 22 with a space 36 between strips 22 and 34 for moisture to escape from the concrete wall 26. The vertical adhesive attachment strips 34 have vertical spaces 36 therebetween and extend down over the protrusions 12 of the dimpled sheet 16. They may be fused to the surfaces 20 of the protrusions 12 or adhered by adhesive. Drainage can occur in the space 14 and any water that enters the drainage space 14 will not be retained therein.

Figure 4:
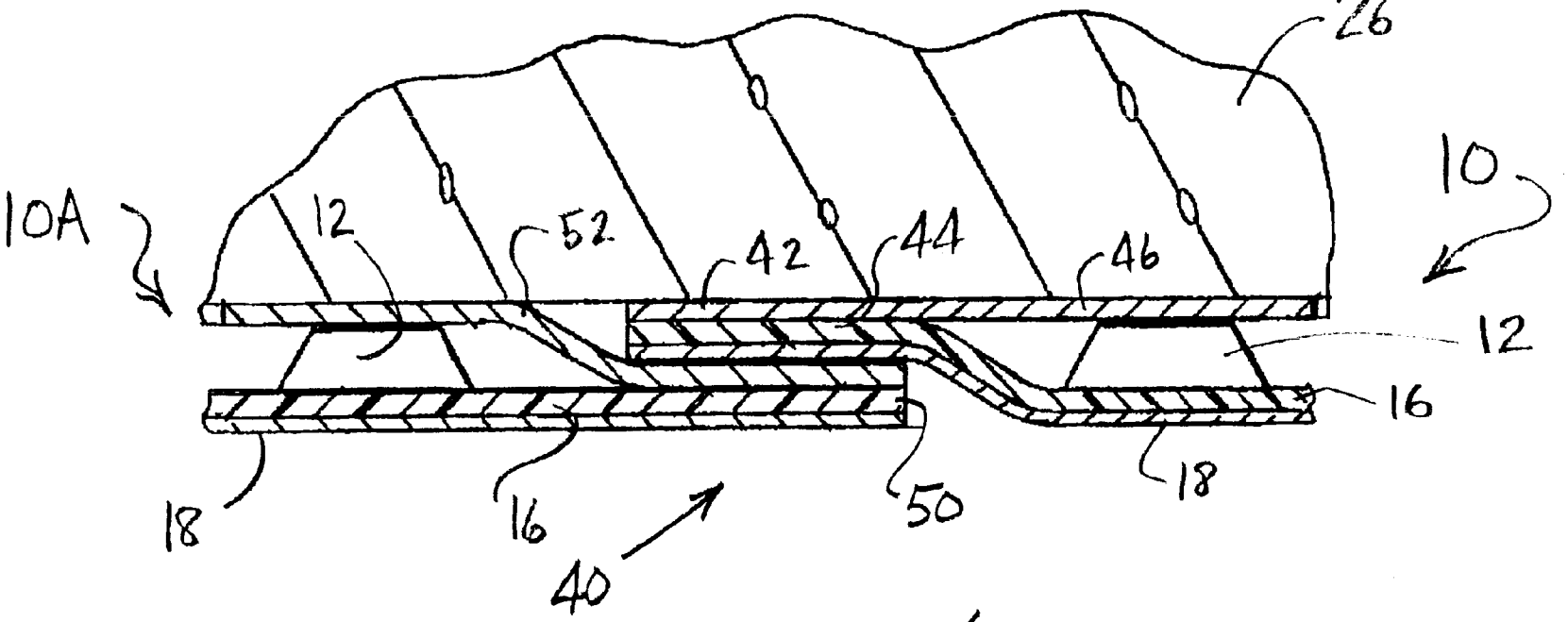
FIG. 4 is a partial cross-sectional view of a portion of an overlap seal between adjacent protectors as shown in FIG. 2 at line 4—4

A vertical overlap seal 40 is shown in FIG. 4 between the protector 10 and an adjacent protector 10A as may be seen in FIG. 2. One vertical side edge 42 on the protector 10 has an offset vertical flat side portion 44 of the waterproof dimpled sheet 16 which is attached to the concrete wall 36 by a vertical adhesive strip 46. The side edge 50 on the adjacent protector 10A has an offset vertical adhesive strip 52 that is attached to the underside of the waterproof dimpled sheet 16 and forms a seal on the membrane 18 with the offset flat side portion 44 of the protector 10. This offset vertical adhesive strip 52 extends under the adjacent row of protrusions 12 on the waterproof dimpled sheet 16 thus assuring that the adjacent protector 10A is sealed to the protector 10 and the concrete wall 26. Leakage is thus prevented between adjacent protectors. The strips 22, 34, and 52 may be double-sided adhesive strips or may be heat-fused at one side to the dimpled sheet 16.

Figure 5:
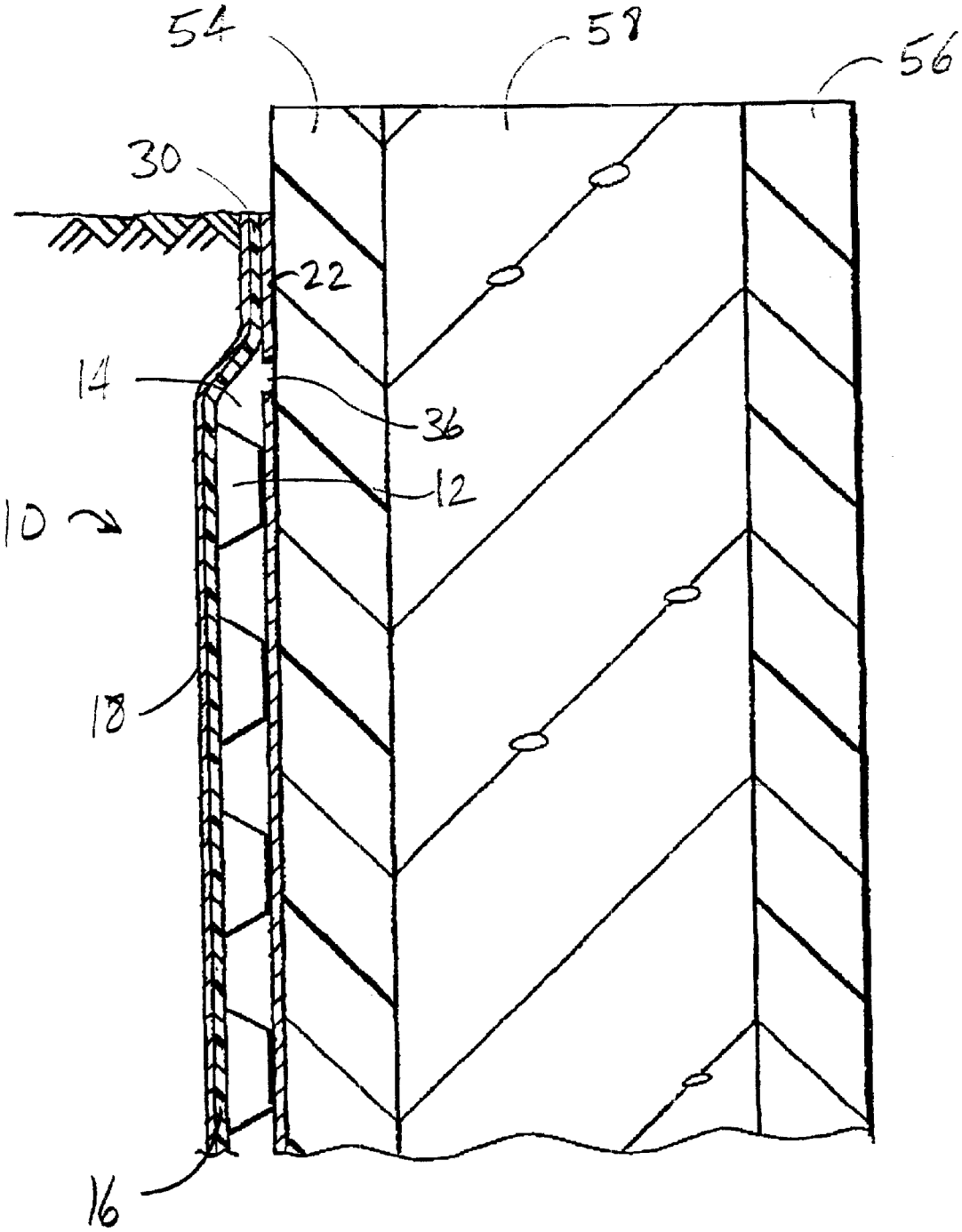
FIG. 5 is a partial cross-sectional view of a foundation protector according to one embodiment of the present invention positioned against a foundation wall of blocks of concrete with insulating foam on each side.

Another use of the protector 10 is shown in FIG. 5 wherein the protector 10 is attached to an insulating foam panel 54 which, with a second insulating foam panel 56, contains a concrete foundation wall 58. The foam panels 54 and 56 are interconnected in a known manner and provide forms during installation for forming the concrete wall 58.

Figure 6:
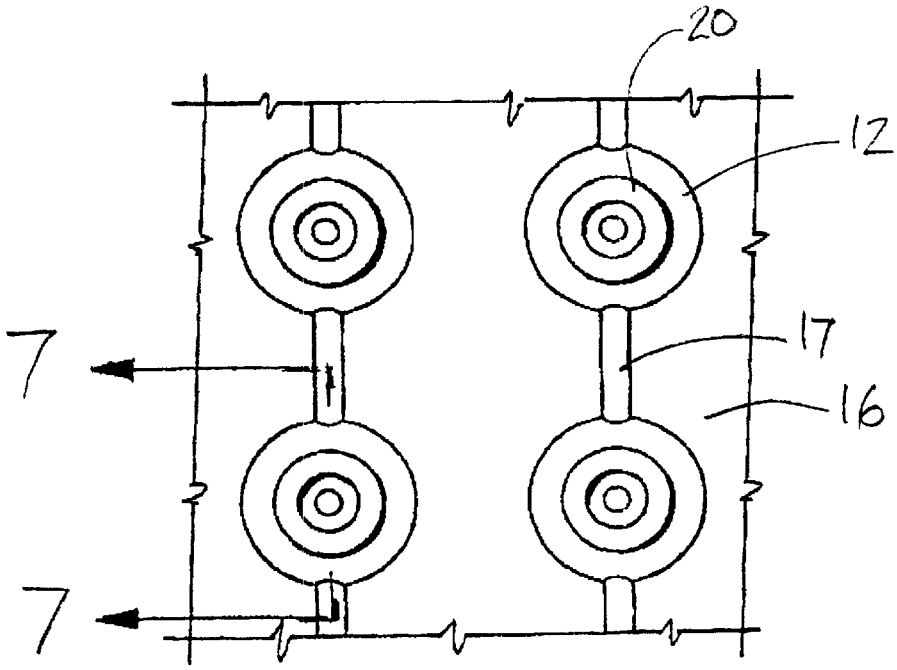
FIG. 6 is a detailed elevational view of a portion of a foundation protector showing protrusions.
Figure 7:
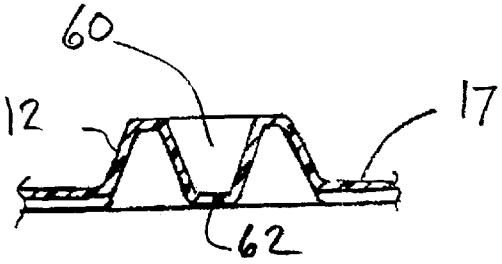
FIG. 7 is a cross-sectional view of one of the protrusions shown in FIG. 6 at line 7—7.
Figure 8:
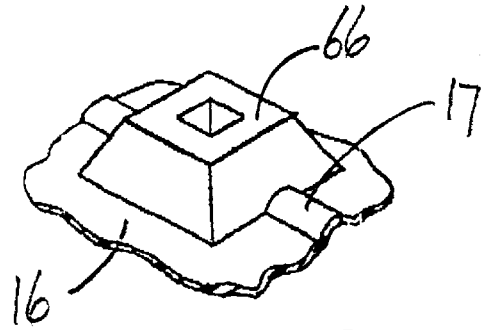
FIGS. 8 and 9 are partial perspective views showing other types of protrusions.
Figure 9:
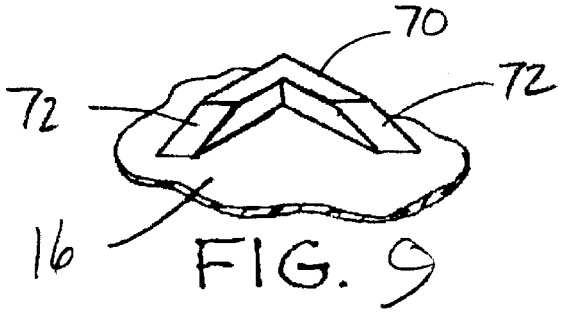

FIG. 6 and FIG. 7 illustrate protrusions 12 which are frusto-conical in shape and have an annular top surface 20 with an indented center aperture 60 which extends downwards to a base 62 level with the waterproof dimpled sheet 16 so membrane 18 remains flat when attached to the sheet 16. FIG. 8 shows another type of protrusion 66 which is in the shape of a truncated pyramid, and FIG. 9 shows a further type of protrusion 70 which is L-shaped with sloping arms 72 at the ends. Protrusions 12 or dimples of other shapes may be used. Raised projections or patterns of vertical or inclined ribs or grooves may be used provided moisture can flow downwards or away from the foundation surface. In other embodiments dimples or protrusions may project from both sides of the waterproof dimpled sheet 16. Such a sheet can provide increased strength. A permeable wicking material pad may be attached to the outside of the membrane 18 so that moisture may drain downwardly between the earth and the membrane.

Preferred embodiments of the invention have been disclosed in the drawings and specification and, although specific terms are employed, it is to be understood and appreciated that they are to be used in a generic and descriptive sense only and not for the purpose of limitation. The scope of the invention is to be limited only by the following claims.

What is claimed is:

1. A foundation protection system, comprising:

a foundation having an outer surface;

a waterproof sheet having an inner surface facing the outer surface of the foundation and an outer surface opposite from the inner surface;

the waterproof sheet having spaced-apart protrusions extending towards the outer surface of the foundation and providing drainage space extending from the foundation to the waterproof sheet;

the protrusions forming recesses on the outer surface of the waterproof sheet; and an outer membrane on the outer surface of the waterproof sheet, the outer membrane covering the recesses and providing a substantially smooth exterior surface.

2. A foundation protection system as claimed in claim 1, wherein the outer waterproof membrane is adhered to the waterproof sheet.

3. A foundation protection system as claimed in claim 1, wherein the outer waterproof membrane is attached to the base portion by beat fusion.

4. A foundation protection system as claimed in claim 1, including a plurality of adhesive strips extending across the protrusions and adhered to the protrusions and to the outer surface of the foundation to secure the waterproof sheet to the foundation, the adhesive strips being spaced apart from one another to provide therebetween gaps extending vertically between the adhesive strips and permitting moisture from the foundation wall to flow downwardly from the outer surface of the foundation.

5. A foundation protection system, comprising:

a first waterproof sheet;

the first waterproof sheet being formed with protrusions extending from one side of the first waterproof sheet and recesses, which correspond to the protrusions, in an opposite side of the first waterproof sheet;

a foundation outer surface;

the protrusions projecting from said one side of the first waterproof sheet towards the foundation outer surface and providing drainage space extending from the first waterproof sheet to the foundation outer surface; and a second waterproof sheet at the opposite side of the first waterproof sheet, the outer waterproof membrane covering the recesses so as to prevent the entry of backfill into the recesses.

6. A foundation protection system as claimed in claim 5, including adhesive securing some of the protrusions to thy foundation outer surface, and gaps between the adhesive permitting moisture to flow downwardly through the drainage space between the first waterproof sheet and the foundation outer surface.

7. A foundation protection system as claimed in claim 6, wherein the adhesive is provided in vertical strips.

8. A foundation protection system as claimed in claim 5, wherein the outer waterproof membrane provides a substantially smooth exterior surface, facing outwardly relative to the foundation outer surface, to counteract movement of the first waterproof sheet and the outer waterproof membrane.

9. A foundation protection system as claimed in claim 5, wherein the first waterproof sheet has a flat top edge portion, and including an adhesive attachment strip between the flat top edge portion and the foundation outer surface, the adhesive attachment strip securing the first waterproof sheet to the foundation outer surface.

10. A foundation protection system as claimed in claim 8, including at least one vertical adhesive attachment strip between the protrusions and the foundation outer surface, the vertical adhesive attachment strip securing the first waterproof sheet to the foundation outer surface.

11. A foundation protection system as claimed in claim 9, wherein the vertical adhesive attachment strip is one of a plurality of vertical adhesive attachment strips adhesively securing the protrusions to the foundation outer surface, and the vertical adhesive attachment strips are spaced apart to provide vertical gaps therebetween.

12. A foundation protection system as claimed in claim 5, wherein the first waterproof sheet has a flat edge portion offset for attachment to the outer surface of the foundation.

13. A foundation protection system as claimed in claim 11, wherein the flat edge portion is atop edge portion of the first waterproof sheet.

14. A foundation protection system as claimed in claim 12, including an adhesive attachment strip between the flat edge portion and the foundation outer surface, the adhesive attachment strip securing the first waterproof sheet to the foundation outer surface.

15. A foundation protection system as claimed in claim 5, wherein the first waterproof sheet has an offset flat edge portion overlapping an adjacent waterproof sheet.

* * * * *